US009213315B2

(12) United States Patent
Takematsu et al.

(10) Patent No.: US 9,213,315 B2
(45) Date of Patent: Dec. 15, 2015

(54) TIMEPIECE WITH MOVABLE ORNAMENTAL BODY

(71) Applicant: SEIKO CLOCK INC., Tokyo (JP)

(72) Inventors: Hiroshi Takematsu, Tokyo (JP); Toyonori Muraji, Tokyo (JP)

(73) Assignee: SEIKO CLOCK INC., Tokyo (JP)

( * ) Notice: Subject to any disclaimer, the term of this patent is extended or adjusted under 35 U.S.C. 154(b) by 0 days.

(21) Appl. No.: 14/243,235

(22) Filed: Apr. 2, 2014

(65) Prior Publication Data

US 2014/0313868 A1 Oct. 23, 2014

(30) Foreign Application Priority Data

Apr. 23, 2013 (JP) ..... 2013-090780

(51) Int. Cl.

| | |
|---|---|
| ***G04B 29/02*** | (2006.01) |
| ***G04B 45/00*** | (2006.01) |
| ***G04B 25/06*** | (2006.01) |
| ***G04B 47/04*** | (2006.01) |

(52) U.S. Cl.

CPC ..... *G04B 29/027* (2013.01); *G04B 25/06* (2013.01); *G04B 45/0038* (2013.01); *G04B 47/044* (2013.01)

(58) Field of Classification Search

CPC ..... G04B 45/00; G04B 45/0023; G04B 45/0038; G04B 25/06; G04B 47/044; G04B 29/027

USPC ..... 368/75, 267, 269, 272, 273

See application file for complete search history.

(56) References Cited

U.S. PATENT DOCUMENTS

| | | | | |
|---|---|---|---|---|
| 4,941,137 | A * | 7/1990 | Kikuchi | 368/223 |
| 5,161,130 | A * | 11/1992 | Sato et al. | 368/228 |
| 5,864,519 | A * | 1/1999 | Nakamura | 368/10 |
| 6,229,768 | B1 * | 5/2001 | Nakazawa et al. | 368/223 |
| 2005/0128884 | A1 * | 6/2005 | Endo et al. | 368/324 |
| 2005/0259522 | A1 * | 11/2005 | Takiguchi | 368/285 |
| 2007/0277578 | A1 * | 12/2007 | Muraji | 72/354.2 |
| 2007/0280055 | A1 * | 12/2007 | Muraji | 368/223 |
| 2008/0239884 | A1 | 10/2008 | Muraji | |
| 2011/0019507 | A1 * | 1/2011 | Muraji | 368/220 |
| 2013/0028057 | A1 * | 1/2013 | Nagatake et al. | 368/228 |

FOREIGN PATENT DOCUMENTS

JP 2008-249643 A1 10/2008

* cited by examiner

*Primary Examiner* — Amy Cohen Johnson
*Assistant Examiner* — Matthew Powell
(74) *Attorney, Agent, or Firm* — Kratz, Quintos & Hanson, LLP

(57) ABSTRACT

A timepiece, which includes a base board made of any of ABS resin, AS resin, and PS resin, and further includes a projection portion; a rotary board made of any of ABS resin, AS resin, and PS resin, and rotatable about and relative to the projection portion; and a rotational shaft projecting toward a front side of the base board through an opening formed in the projection portion. An end of the rotational shaft is connected with a hand provided for indicating time. The timepiece further includes an ornamental body movable relative to the base board; and a securing member made of any of POM resin, PBT resin, and PA resin. The ornamental body is prevented from moving forward to the front side and coming into contact with the hand provided for indicating time when, for example, shock is applied to the timepiece.

5 Claims, 14 Drawing Sheets

TIMEPIECE WITH MOVABLE ORNAMENTAL BODY

CROSS-REFERENCE TO RELATED APPLICATION

This application is based upon and claims priority to Japanese Patent Application No. 2013-090780 filed on Apr. 23, 2013, subject matter of these patent documents is incorporated by reference herein in its entirety.

BACKGROUND (i) Technical Field

The present invention relates to timepieces.

(ii) Related Art

There is known a timepiece including: a base board; a rotary board rotatably sliding on the base board; and an ornamental body moving in a position spaced away from the base board. For example, the base board may be secured with a securing member surrounding a rotational shaft of a hand. The securing member prevents the ornamental body from coming into contact with the hand or the rotational shaft. Such a timepiece is disclosed in Japanese Patent Application Publication No. 2008-249643.

For example, the base board may be made of ABS resin in order to ensure its strength. Also, the rotary board may be made of POM resin. However, in a case where the rotary board is made of the POM resin, warpage of the rotary board might be caused depending on its size. Herein, in a case where the rotary board is made of the ABS resin, the warpage is suppressed. However, in a case where the base board and the rotary board are made of the ABS resin, parts thereof made of the same material slide on each other, so abrasion and sliding noise might be increased. Also, in a case where the base board and the rotary board sandwich a member having a good slidability, the abrasion and the sliding noise can be reduced. However, the number of parts are increased.

It is therefore an object of the present invention to provide a timepiece suppressing abrasion and drive noise, and suppressing an increase in the number of parts.

According to an aspect of the present invention, there is provided a timepiece including:

a base board made of any of ABS resin, AS resin, and PS resin, and including a projection portion; a rotary board made of any of ABS resin, AS resin, and PS resin, and rotatable about and relative to the projection portion; a rotational shaft projecting toward a front side of the base board through an opening formed in the projection portion, an end of the rotational shaft being connected with a hand provided for indicating time; an ornamental body movable relative to the base board; and a securing member made of any of POM resin, PBT resin, and PA resin, and including: a tube portion through which the rotational shaft penetrates; a flange portion projecting radially outward of the tube portion, and positioned between the hand and a part of the ornamental body when the ornamental body is stopped; a securing portion secured to the projection portion; a surrounding portion surrounding the projection portion, the rotary board sliding on outer circumference of the surrounding portion; and a pressing portion positioned in a front side of the rotary board and projecting radially outward from the surrounding portion.

DETAILED DESCRIPTION

Figure 1:
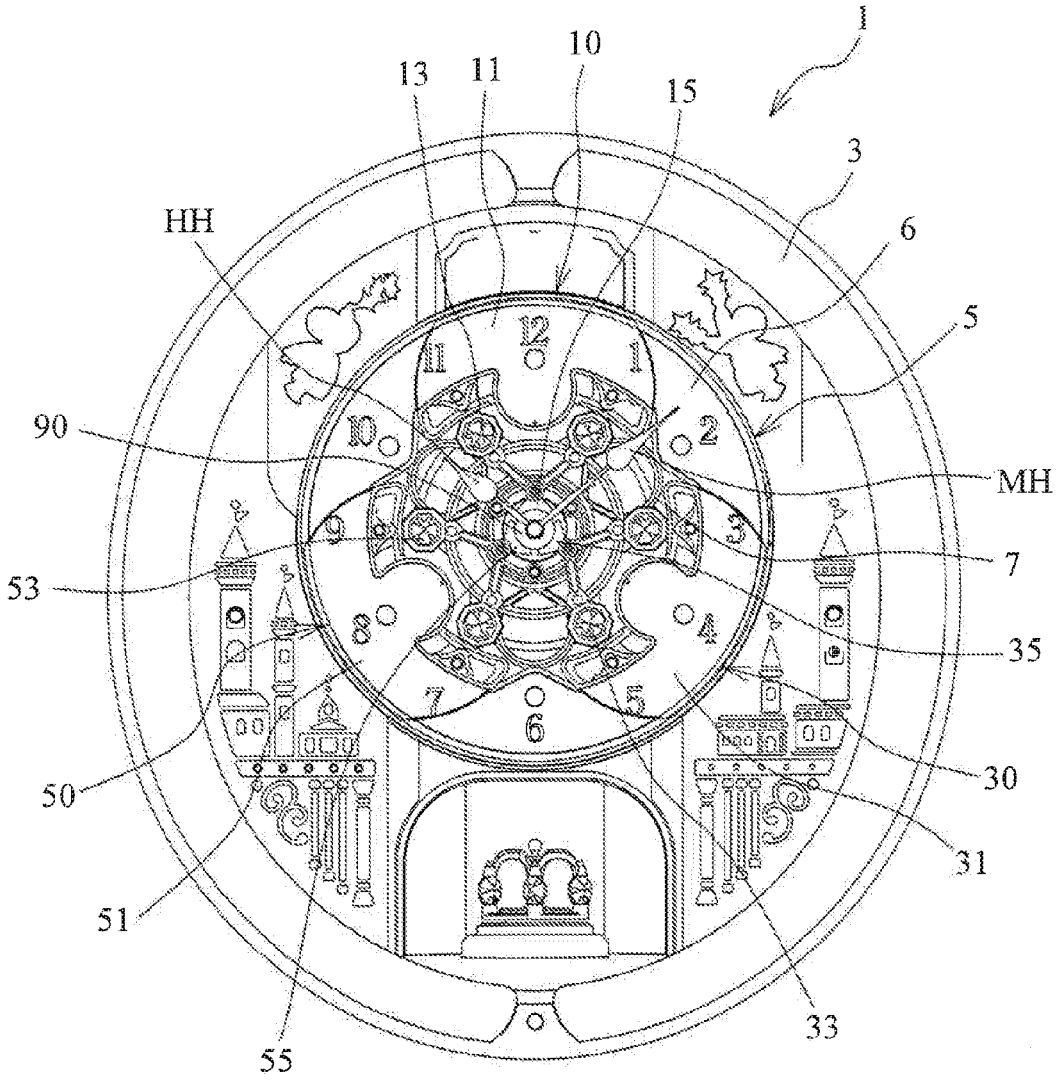
FIG. 1 is a front view of a timepiece.

FIG. 1 is a front view of a timepiece 1. The timepiece 1 includes: a front board 3 to which decoration is applied; an ornamental board 5 rotatably arranged within an opening formed at a substantial center of the front board 3; and ornamental bodies 10, 30, and 50 movably arranged in a front side of the ornamental board 5. Also, the timepiece 1 includes: a minute hand MH and a hour hand HH showing the time; and a securing member 90 for protecting rotational shafts coupled therewith. The securing member 90 is located at a substantial center of the timepiece 1. FIG. 1 illustrates the state where the ornamental board 5, the ornamental body 10, and the like stop at respective initial positions.

The ornamental board 5 has a substantial round shape and includes: a board portion 6 on which numbers for indicating the time are denoted; and an ornamental portion 7 to which decoration is applied and which is positioned closer to the center than the board portion 6. On the board portion 6, the numbers "2", "6", and "10" are denoted at equal angular intervals. The ornamental portion 7 is formed with plural rod-shaped portions that are curved.

The ornamental body 10 includes: a board portion 11 on which numbers are denoted; an ornamental portion 13 formed to extend to the securing member 90 from the board portion 11; and an end portion 15 positioned in the vicinity of the securing member 90. The ornamental portion 13 is formed with plural rod-shaped portions some of which are straight and the other of which are curved. Likewise, the ornamental bodies 30 and 50 respectively include board portions 31 and 51, ornamental portions 33 and 53, and end portions 35 and 55. The numbers "11", "12", and "1" are denoted on the board portion 11. The numbers "3", "4", and "5" are denoted on the board portion 31. The numbers "7", "8", and "9" are denoted on the board portion 51. In an initial state illustrated in FIG. 1, the ornamental bodies 10, 30, and 50 are arranged to expose the numbers denoted on the ornamental board 5, the ornamental board 5 and the ornamental bodies 10, 30, and 50 are maintained in a round shape as a whole, and these members function as a single dial plate as a whole.

Figure 2:
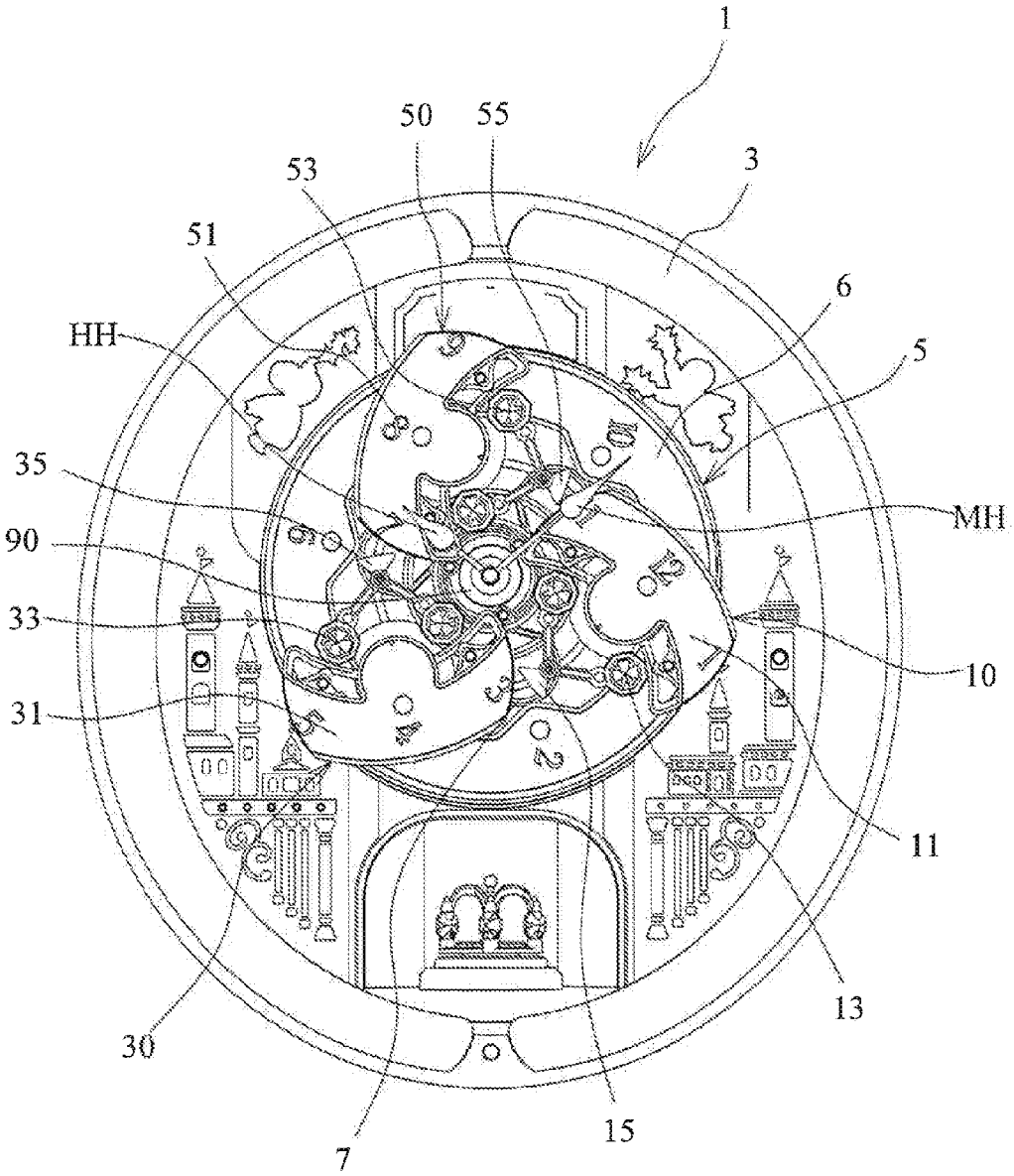
FIG. 2 is a front view of the timepiece.

When a predetermined time has come, the ornamental board 5 rotates about the securing member 90 from the initial state illustrated in FIG. 1 and the ornamental bodies 10, 30, and 50 rotate while revolving about the securing member 90 as illustrated in FIG. 2. Specifically, the ornamental board 5 rotates clockwise from the initial state, and the ornamental bodies 10, 30, and 50 rotate clockwise while revolving clockwise about the rotational center of the ornamental board 5. Also, music is output from a speaker not illustrated, while the ornamental board 5 and the like are rotating. After a predetermined time elapses, the ornamental board 5 rotates counterclockwise and the ornamental board 5 and the ornamental bodies 10, 30, and 50 return to the respective initial positions, and then music is stopped. In this way, the timepiece 1 performs such a mechanical movement in a predetermined time. In addition, actually, the ornamental board 5 rotates from the initial state, stops in the part way, or rotates reversely, so that the ornamental board 5 as a whole finally rotates clockwise. When the ornamental board 5 rotates counterclockwise, the ornamental bodies 10, 30, and 50 revolve and rotate counterclockwise. In the timepiece 1, the ornamental board 5 rotates, and the ornamental bodies 10, 30, and 50 revolve and rotate in such a way. This presents a wide variety of appearances.

Figure 3:
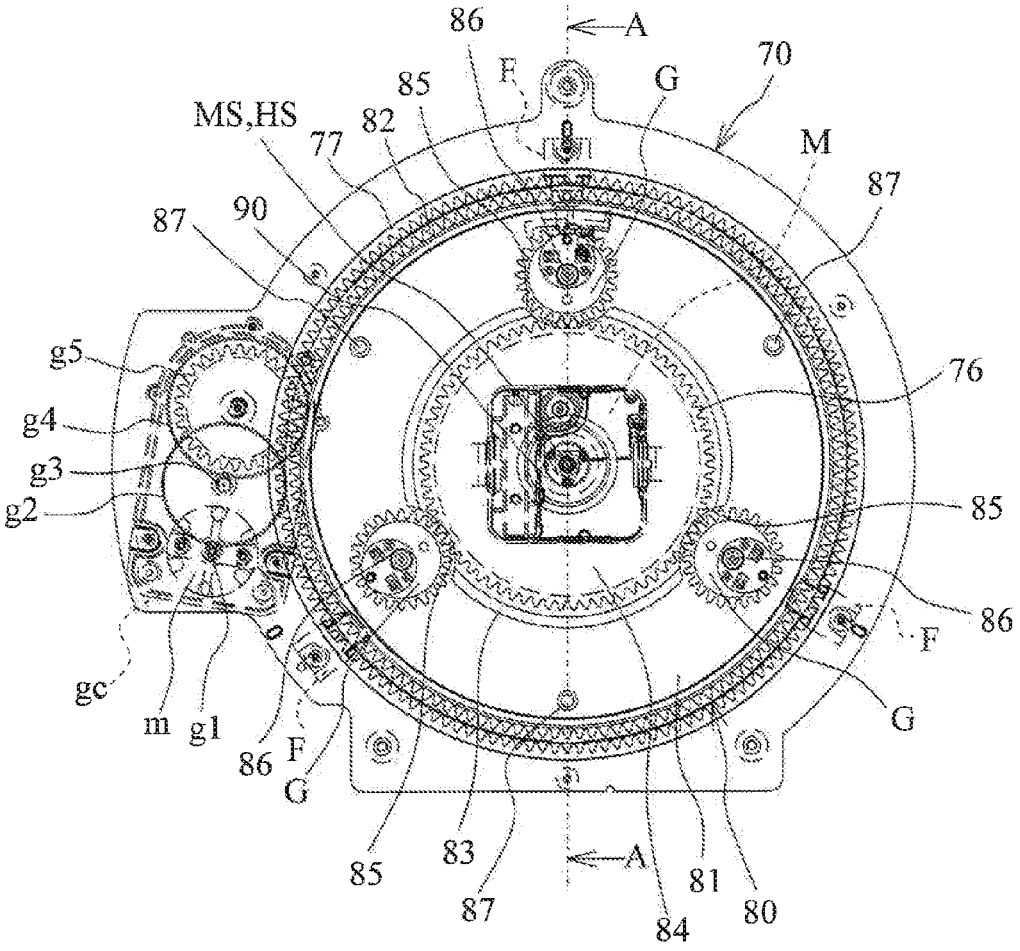
FIG. 3 is an explanatory view of a drive mechanism of the timepiece.
Figure 4:
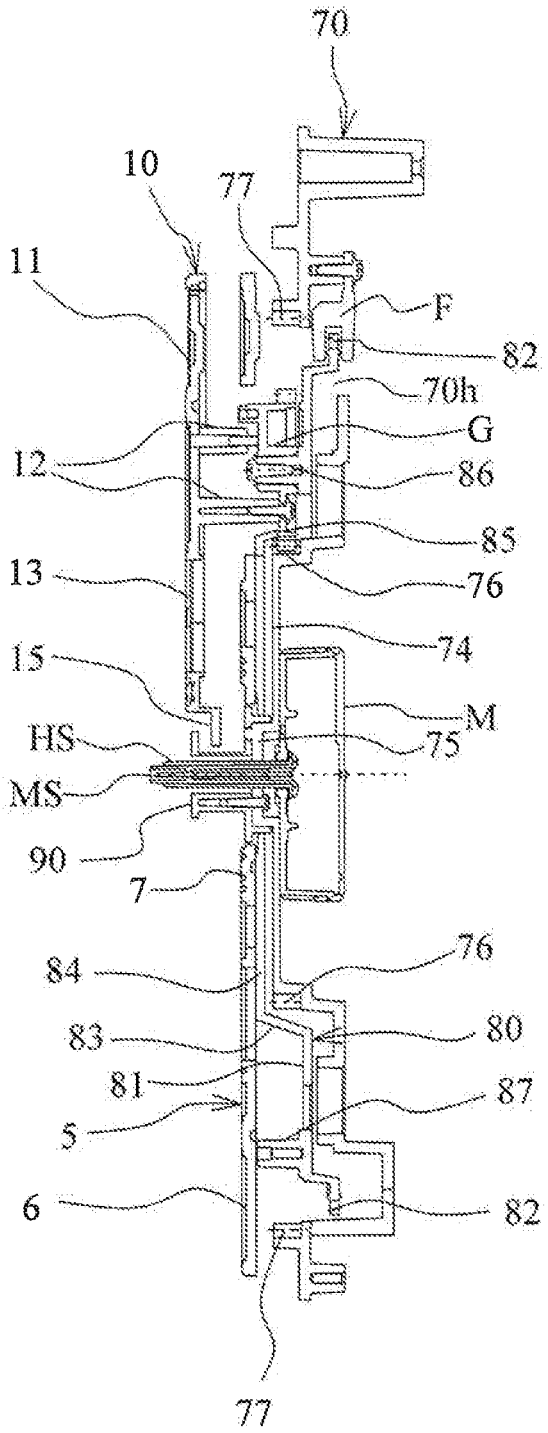
FIG. 4 is a sectional view taken along line A-A of FIG. 3.

FIG. 3 is an explanatory view of a drive mechanism of the timepiece 1. FIG. 4 is a sectional view taken along line A-A of FIG. 3. Additionally, although FIG. 3 does not illustrate the ornamental board 5 or the ornamental bodies 10, 30, and 50, FIG. 4 illustrates the ornamental board 5 and the ornamental body 10. A base board 70 is arranged in a rear side of the front board 3. In the rear side of the base board 70, a movement M is provided for driving the minute hand MH and the hour hand HH, and a gear case gc that houses a motor m and the like is provided for driving the ornamental board 5, the ornamental body 10, and the like. In the front side of the base board 70, a rotary board 80 is arranged for rotation relative to the base board 70. The rotary board 80 rotates about the securing member 90. The rotary board 80 is rotated by the motor m, and in response to this, the ornamental board 5 rotates, and the ornamental body 10 and the like rotate while revolving. The base board 70, the rotary board 80, the gear case gc, and the motor m correspond to a drive mechanism for driving the ornamental board 5, the ornamental body 10, and the like.

Within the gear case gc, there are arranged the motor m, a gear g2 meshing with a gear g1 of the motor m, a gear g3 coaxially secured to the gear g2 and having a pitch diameter smaller than that of the gear g2, a gear g4 meshing with the gear g3, and a gear g5 coaxially secured to the gear g4 and having a pitch diameter smaller than that of the gear g4. The rotational drive force of the motor m is reduced and transmitted to the gear g5.

The gear g5 engages a teeth portion 82 formed in an outer circumferential edge of the rotary board 80. Therefore, the rotary board 80 rotates relative to the base board 70. Also, the teeth portion 82 is formed into a circular shape about the rotational center of the rotary board 80. The rotary board 80 has a substantially round shape, and the outer circumferential edge portion thereof is sandwiched by three holding members F. The holding members F are secured to the rear side of the base board 70. The base board 70 is formed with a notch **70*h* for receiving the outer circumferential portion of the rotary board 80. The outer circumferential portion of the rotary board 80 are supported by the holding members F through the notch 70*h*. Also, the rotary board 80 is supported by the holding members F so as to be slightly spaced from the base board 70** in the forward direction.

The rotary board 80 is provided with the teeth portion 82, an outer side portion 81, an inclined portion 83, and an inner side portion 84, in this order from the radially outer side to the radially inner side. The inclined portion 83 extends toward the front side from the outer side portion 81. The inner side portion 84 is located in the front side of the outer side portion 81. The inner side portion 84 and the outer side portion 81 are substantially parallel to each other. The ornamental board 5 is secured to the inner side portion 84. The outer side portion 81 is located in the front side of the base board 70 and has a substantially planar shape. The outer side portion 81 is provided with: three spindle portions 86; and three spindle portions 87 that are more distant from the rotational center of the rotary board 80 than the spindle portions 86. The three spindle portions 86 are the same in distance from the rotational center of the rotary board 80. The three spindle portions 87 also have a similar arrangement. The three spindle portions 86 are positioned at even angular intervals, specifically, at 120 degree-intervals. The three spindle portions 87 also have a similar arrangement. The spindle portions 86 and 87 are adjacent to one another. The angular interval between the adjacent spindle portions 86 and 87 is the same as that between other adjacent spindle portions 86 and 87. The angle between the adjacent spindle portions 86 and 87 is 60 degrees.

The three spindle portions 86 support respective gears G for rotation. Although the three spindle portions 87 do not support the gears G, the three spindle portions 87 are capable of supporting the respective gears G. The three gears G are secured to the respective ornamental bodies 10, 30, and 50 mentioned above. As illustrated in FIG. 4, the gear G is secured to plural secured spindles 12 extending from the rear side of the ornamental body 10. The other ornamental bodies 30 and 50 have the same arrangement. The rotation of the rotary board 80 permits the three gears G to revolve about the rotational center of the rotary board 80. Also, in response to this, the three gears G mesh with an outer teeth portion 76 of the base board 70. The spindle portions 86 that support the three gears G for rotation are each an example of a first spindle portion.

The outer teeth portion 76 is formed into a round shape about the rotational center of the rotary board 80. The inclined portion 83 of the rotary board 80 is formed to surround the outer teeth portion 76 of the base board 70, and is partially formed with cutout portions 85 for exposing the outer teeth portion 76 of the base board 70. The gears G supported by the spindle portions 86 mesh with the outer teeth portion 76 of the base board 70 through the respective cutout portions 85. Thus, when the rotary board 80 rotates clockwise, the gears G mesh with the outer teeth portion 76 and rotate clockwise while revolving clockwise. Thus, the ornamental bodies 10, 30, and 50 secured to the respective these gears G rotate while revolving.

Additionally, since the ornamental board 5 is secured to the rotary board 80, the ornamental board 5 rotates together with the rotary board 80.

Also, the base board 70 is formed with an inner teeth portion 77 that is positioned outside the outer teeth portion 76 and that is concentrically formed therewith. The spindle portions 87 are provided to be closer to the inner teeth portion 77 than to the outer teeth portion 76. The spindle portions 86 are provided to be closer to the outer teeth portion 76 than to the inner teeth portion 77. The inner teeth portion 77 will be described later.

Figure 5:
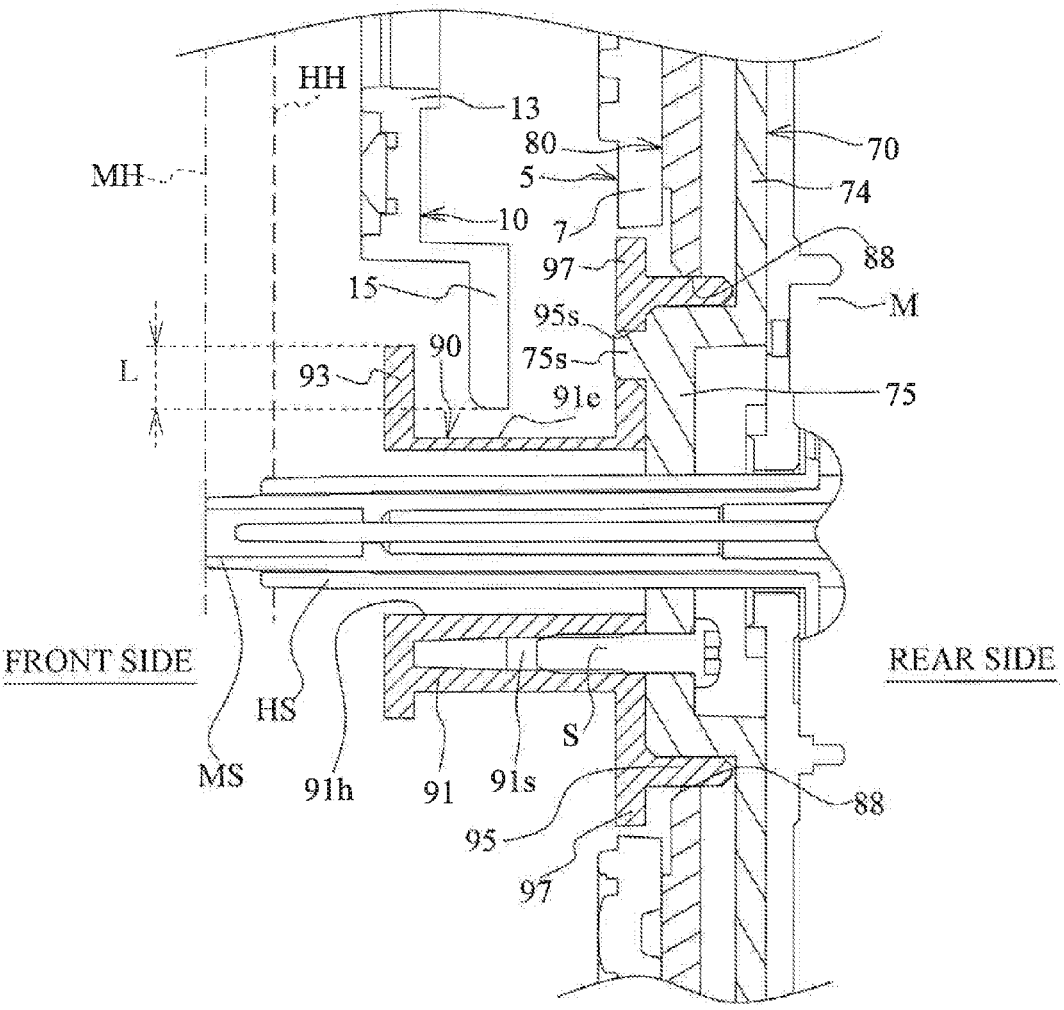
FIG. 5 is a partial enlarged view of FIG. 4.

FIG. 5 is a partially enlarged view of FIG. 4. Additionally, in FIG. 5, some parts are illustrated by hatching to facilitate understanding. The base board 70 includes: an inner side portion 74 facing the rotary board 80 with the movement M secured to a rear side of the inner side portion 74; and a projection portion 75 projecting to the front side from the inner side portion 74. Rotational shafts MS and HS rotated by the movement M are connected to the minute hand MH and the hour hand HH, respectively. The rotational shafts MS and HS project to the front side through a through-hole formed in the projection portion 75. The projection portion 75 projects to have a substantially round shape when viewed from the front side. The projection portion 75 is secured to the securing member 90. The securing member 90 has a substantially tubular shape. The rotary board 80 is formed with an opening 88 for receiving the projection portion 75 and a part of the securing member 90, and rotates about the projection portion 75. A part of the securing member 90 is intervened between the opening 88 and the projection portion 75. The base board 70, the rotary board 80, and the securing member 90 are made of a synthetic resin. Specifically, the securing member 90 is made of polyacetal resin (POM). The base board 70 and the rotary board 80 are made of acrylonitrile-butadiene-styrene resin (ABS). Further, the holding members F supports the rotary board 80 to maintain a predetermined clearance between the rotary board 80 and the inner side portion 74 of the base board 70. Therefore, the base board 70 and the rotary board 80 do not come into contact with each other.

Figure 6A:
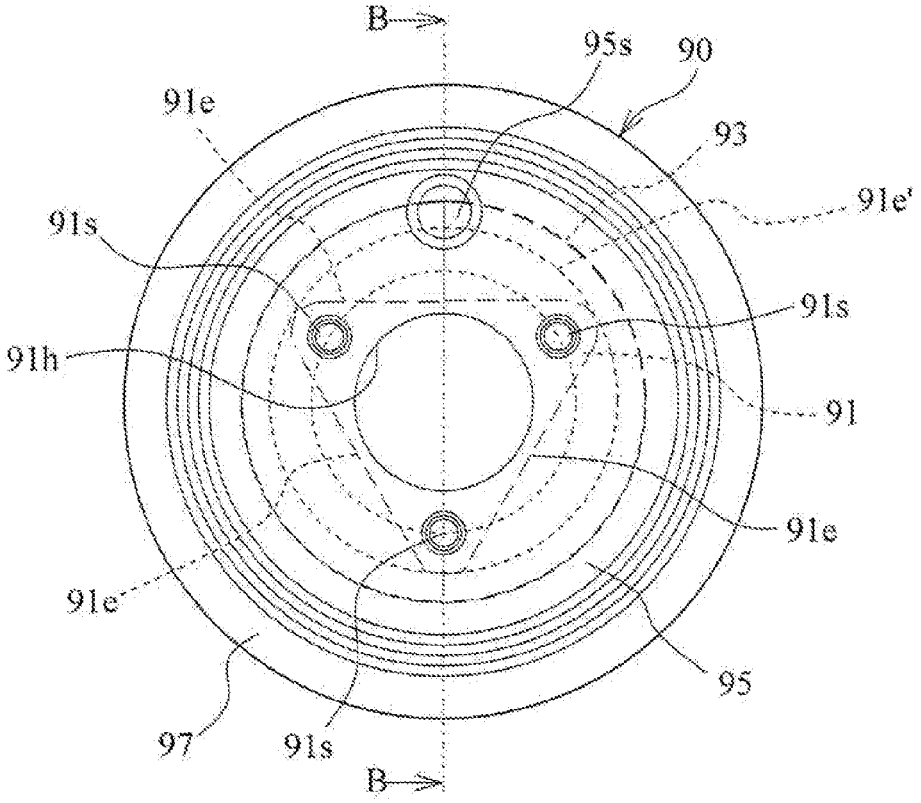
FIGS. 6A and 6B are explanatory views of a securing member.
Figure 6B:
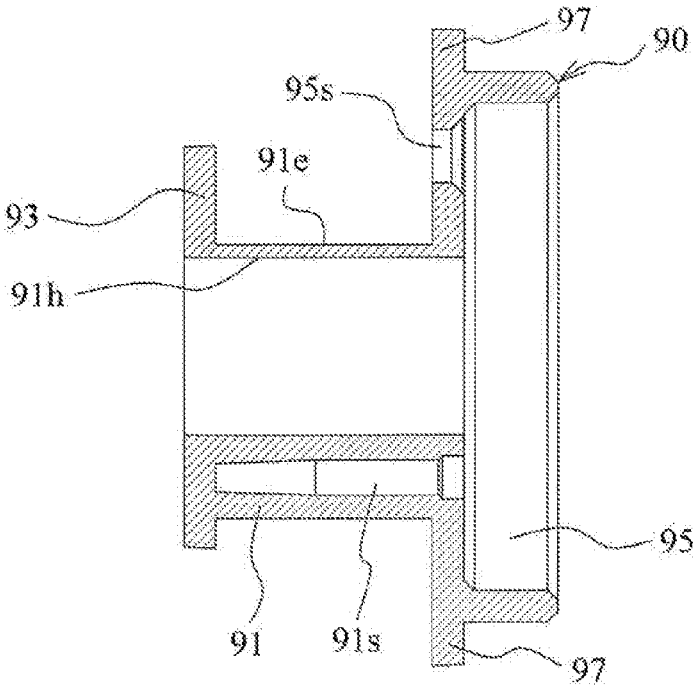

The securing member 90 will be described below. FIG. 6A is a rear view of the securing member 90. FIG. 6B is a sectional view taken along line B-B of FIG. 6A. The securing member 90 includes: a tube portion 91; a flange portion 93; a surrounding portion 95; and a pressing portion 97. An outer shape of the tube portion 91 is a non-cylindrical shape. The rotational shafts MS and HS penetrate through a hole 91*h* of the tube portion 91, and are surrounded thereby. This arrangement prevents the end portion 15 of the ornamental body 10 or the like from coming into contact with the rotational shafts MS and HS, for example, when the shock is applied to the timepiece 1.

The flange portion 93 projects radially outward from an end portion of the front side of the tube portion 91. As illustrated in FIG. 1, in the initial state where the ornamental bodies 10, 30, and 50 stop, the flange portion 93 partially overlaps the end portions 15, 35, and 55 of the ornamental bodies 10, 30, and 50 when viewed from the front side. In particular, as illustrated in FIG. 5, the flange portion 93 is located in the front side of the end portions 15, 35, and 55, and located in the rear side of the minute hand MH and the hour hand HH. That is, the flange portion 93 is located between parts of the ornamental bodies 10, 30, and 50, and the minute hand MH and the hour hand HH. Also, the flange portion 93 and the end portion 15 overlap each other only by a distance L. This arrangement prevents the end portion 15 of the ornamental body 10 or the like from moving to the front side and coming into contact with the minute hand MH and the hour hand HH, for example, when the shock is applied to the timepiece 1. The end portions 35 and 55 have a similar arrangement.

Three screw holes 91*s* are formed in the circumference of the tube portion 91. A screw S penetrates through a receiving hole formed in the projection portion 75 and is screwed into the screw hole 91*s*, whereby the securing member 90 is secured to the projection portion 75. The screw hole 91*s* is an example of a securing portion. The surrounding portion 95 is provided at an end portion on the rear side of the tube portion 91, and has a substantially flat cylindrical shape, a diameter of which is greater than that of the hole 91*h*. The surrounding portion 95 fits on the projection portion 75 of the base board 70 and surrounds the circumference of the projection portion 75. The surrounding portion 95 is formed with a hole 95*s*, into which a boss portion 75*s* is fitted. The boss portion 75*s* is provided in the projection portion 75 and is provided for positioning. The hole 95*s* is fitted with the boss portion 75*s*, thereby preventing the securing member 90 from rotating relative to the projection portion 75. The surrounding portion 95 is located between the opening 88 of the rotary board 80 and the projection portion 75. Thus, an inner circumferential surface of the opening 88 of the rotary board 80 slides on an outer circumferential surface of the surrounding portion 95.

The pressing portion 97 projects from the surrounding portion 95 radially outward, and is located in the front side of the rotary board 80. It is thus suppressed that, for example, shock causes the rotary board 80 to move forward and to be disengaged from the projection portion 75.

Also, as illustrated in FIG. 6A, the hole 91*h* of the tube portion 91 has a round shape when viewed from the front side. However, the outer circumference of the tube portion 91 is provided with three outer flat surfaces 91*e*, and the tube portion 91 has a substantially triangular tube shape. It is assumed that a tube portion 91*e*' is not provided with the outer flat surfaces 91*e* of the tube portion 91. The outer flat surfaces 91*e* provided as an outer profile of the tube portion 91 are located closer to the center axis of the securing member 90 than the outer circumference of the tube portion 91*e*'. The tube portion 91*e*' is a virtual cylinder. The virtual cylinder is concentric with the tube portion 91 and passes through a point on the outer profile thereof, the point being the most distant from the center thereof. With such an outer profile of the tube portion 91, the end portions of the movable ornamental bodies 10, 30, and 50 can be located closer to the center axis of the securing member 90 than the outer circumference of the tube portion 91*e*', to such an extent as not to abut the outer flat surfaces 91*e*. That is, the end portions of the ornamental bodies 10, 30, and 50 can come close to the tube portion 91 to overlap the tube portion 91*e*'. Therefore, while the movable range of the ornamental bodies 10, 30, and 50 is ensured as large as possible, the ornamental bodies 10, 30, and 50 can be moved to the center of the timepiece 1. Also, while the distance L by which the flange portion 93 overlaps the end portions of the ornamental bodies 10, 30, and 50 is ensured, the flange portion 93, and the ornamental bodies 10, 30, and 50 can be moved to the center of the timepiece 1. Thus, the securing member 90 is suppressed from standing out when the timepiece 1 is viewed from the front side, and the whole size of the timepiece 1 can be reduced. In addition, the outer profile of the tube portion 91 corresponds to shapes of the end portions 15, 35, and 55 of the ornamental bodies 10, 30, and 50. That is, the end portion 15 has a substantially triangle shape as illustrated in FIG. 2, and one side of the end portion 15 having the triangle shape faces the outer flat surface 91*e* of the tube portion 91 in the initial state illustrated in FIG. 1.

As mentioned above, the outer side portion 81 of the rotary board 80 is provided with two types of the spindle portions 86 and 87 that are different from each other in distance from the rotational center. For this reason, the outer side portion 81 has a large area, and the rotary board 80 itself is also large. Further, it is preferable that the rotary board 80 has a reduced weight for rotation, and it is therefore preferable that a thickness thereof is thin to some extent. If the rotary board 80 designed in such a way is made of, for example, a POM resin, the rotary board 80 might be warped. In the present embodiment, the rotary board 80 is made of the ABS resin that can suppress warpage from being generated in forming, as compared with the POM resin. This can suppress the warpage of the rotary board 80, and can also achieve a reduced thickness and a reduced weight. In addition, the base board 70 and the rotary board 80 may be made of an acrylonitrile styrene copolymer (AS resin) or a polystyrene resin (PS resin). In this case, the warpage of the rotary board 80 can be suppressed. Further, the base board 70 and the rotary board 80 may be made of materials, of these materials, different from each other.

As mentioned above, the base board 70 and the rotary board 80 are made of the ABS resin. In a case where the base board 70 and the rotary board 80 made of the ABS resin have surfaces that slide on each other and that have large areas, abrasion and drive noise might be increased. In the present embodiment, as illustrated in FIG. 5, the rotary board 80 slides on the outer circumference of the surrounding portion 95 of the securing member 90 made of the POM resin, but not slide on the projection portion 75 of the base board 70. The POM resin is a material with a good sliding property and leads to slide, thereby suppressing the abrasion and the drive noise of the rotary board 80. The securing member 90 may be made of a polybutylene terephthalate resin (PBT resin) or a polyamide resin (PA resin). These materials have a good sliding property and lead to slide.

As mentioned above, the securing member 90 protects the rotational shafts MS and HS, the minute hand MH, and the hour hand HH, prevents the rotary board 80 from being detached from the inner portion 74 of the base board 70, and suppresses the abrasion between the rotary board 80 and the base board 70. Thus, some functions are consolidated in the securing member 90, thereby suppressing an increase in the number of parts.

Figure 7:
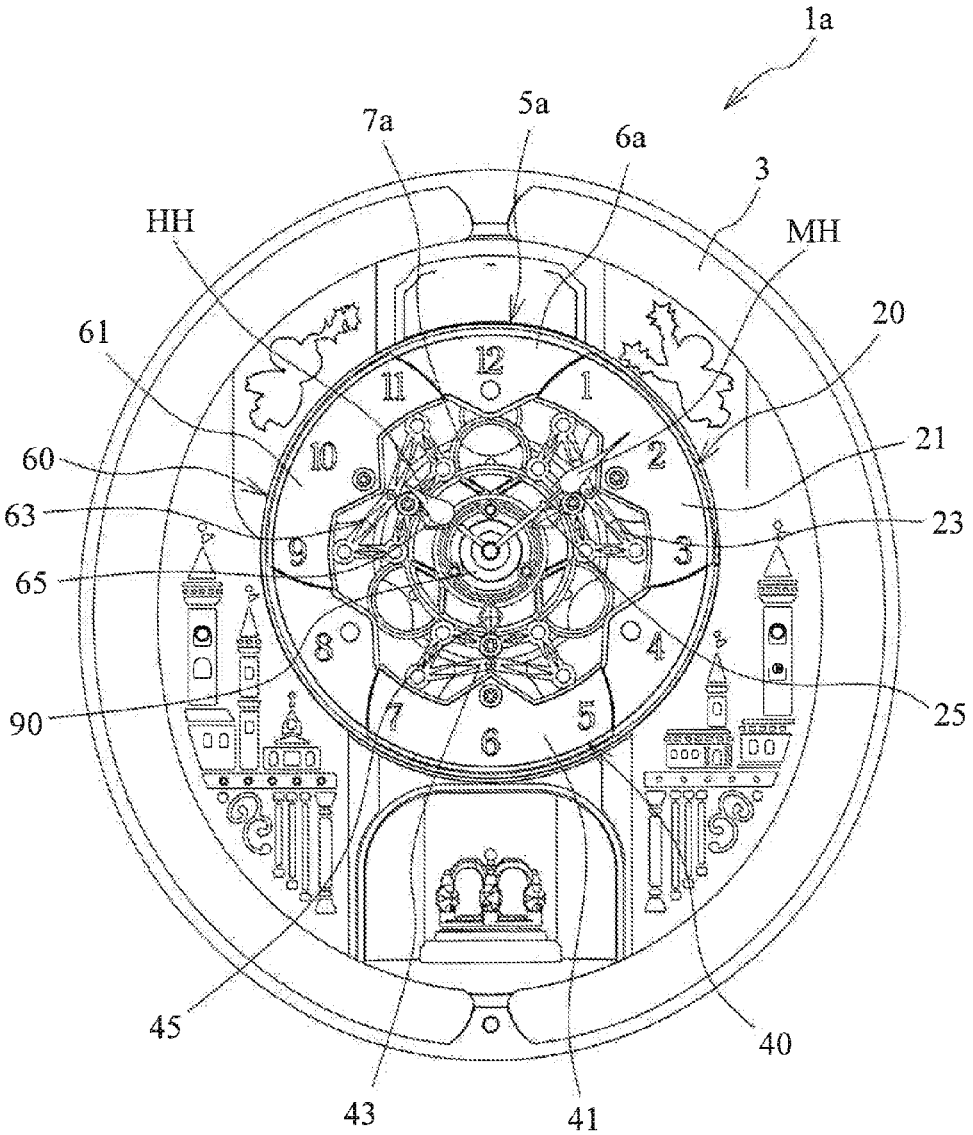
FIG. 7 is a front view of a timepiece according to a first variation.
Figure 8:
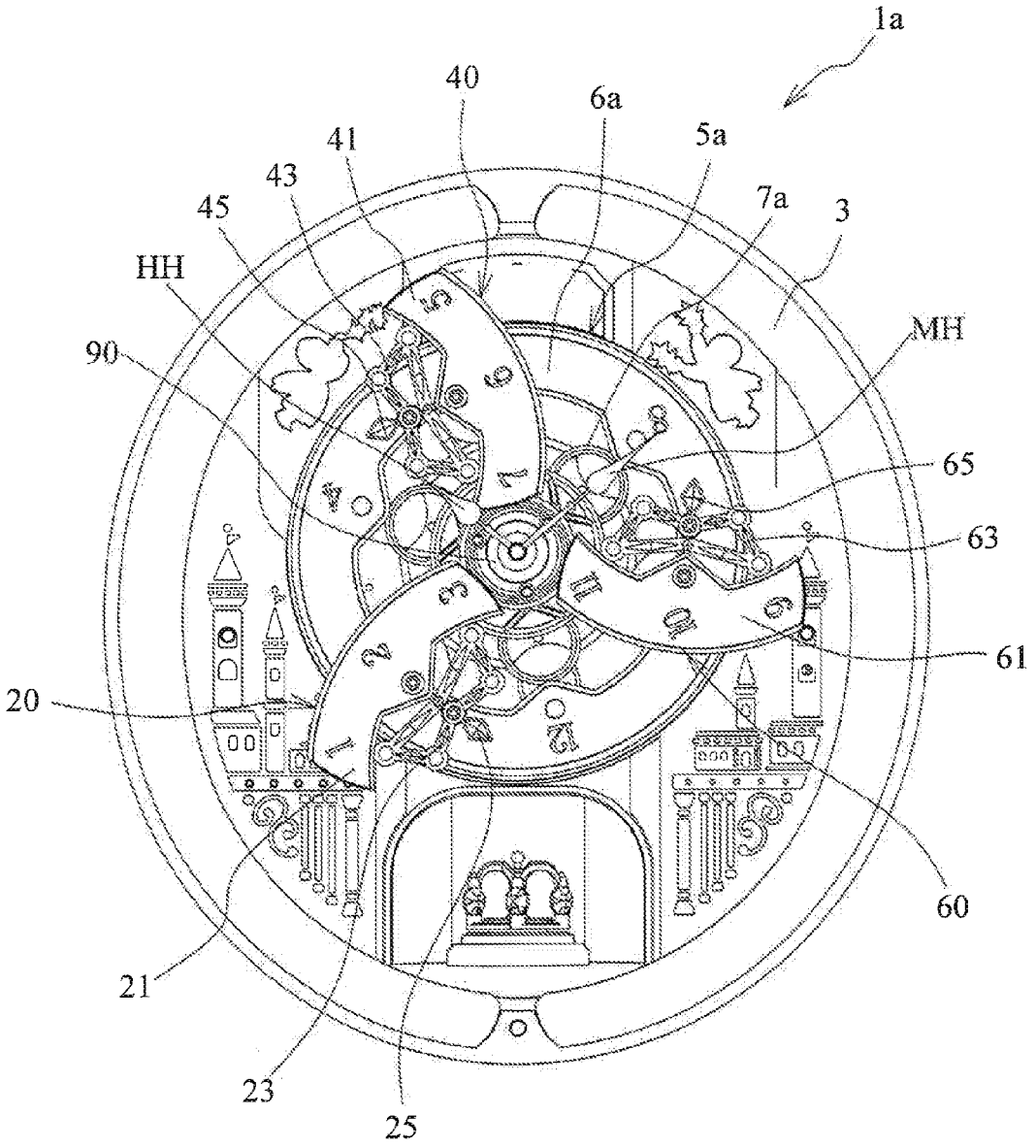
FIG. 8 is a front view of the timepiece according to the first variation.

Next, a timepiece 1*a* according to a first variation will be described below. FIGS. 7 and 8 are front view of the timepiece 1*a* according to the first variation. Additionally, the same components have the same reference numerals in order to avoid a duplicated explanation. The timepiece 1*a* employs common components of the timepiece 1.

An ornamental board 5*a* includes: a board portion 6*a* on which the numbers "12", "4", and "8" are denoted; and an ornamental portion 7*a* to which decoration is applied and which is positioned closer to the center than the board portion 6*a*. Ornamental bodies 20, 40, and 60 are movably arranged in a front side of the ornamental board 5*a*. The ornamental body 20 includes: a board portion 21 on which numbers are denoted; an ornamental portion 23 formed to extend to the securing member 90 from the board portion 21; and an end portion 25 positioned in the vicinity of the securing member 90. Likewise, the ornamental bodies 40 and 60 respectively include board portions 41 and 61, ornamental portions 43 and 63, and end portions 45 and 65. The numbers "1", "2", and "3" are denoted on the board portion 21. The numbers "5", "6", and "7" are denoted on the board portion 41. The numbers "9", "10", and "11" are denoted on the board portion 61. In an initial state illustrated in FIG. 7, the ornamental board 5*a* and the ornamental bodies 20, 40, and 60 are maintained in a round shape as a whole, and these members function as a single dial plate as a whole. Additionally, in the initial state of FIG. 7, the end portion 25 of the ornamental body 20 is spaced from the securing member 90. The ornamental bodies 40 and 60 also have a similar arrangement.

When a predetermined time has come, the ornamental board 5*a* rotates clockwise from an initial state illustrated in FIG. 7, as illustrated in FIG. 8. The ornamental bodies 20, 40, and 60 rotate counterclockwise while revolving clockwise about the rotational center of the ornamental board 5*a*. After a predetermined time elapses, the ornamental board 5*a*, the ornamental body 20, and the like return to the respective initial positions. When the ornamental board 5*a* rotates counterclockwise, the ornamental bodies 20, 40, and 60 rotate clockwise while revolving counterclockwise. In the timepiece 1*a*, the ornamental board 5*a* rotates, and the ornamental body 20 and the like revolve and rotate. This presents a wide variety of appearances.

Figure 9:
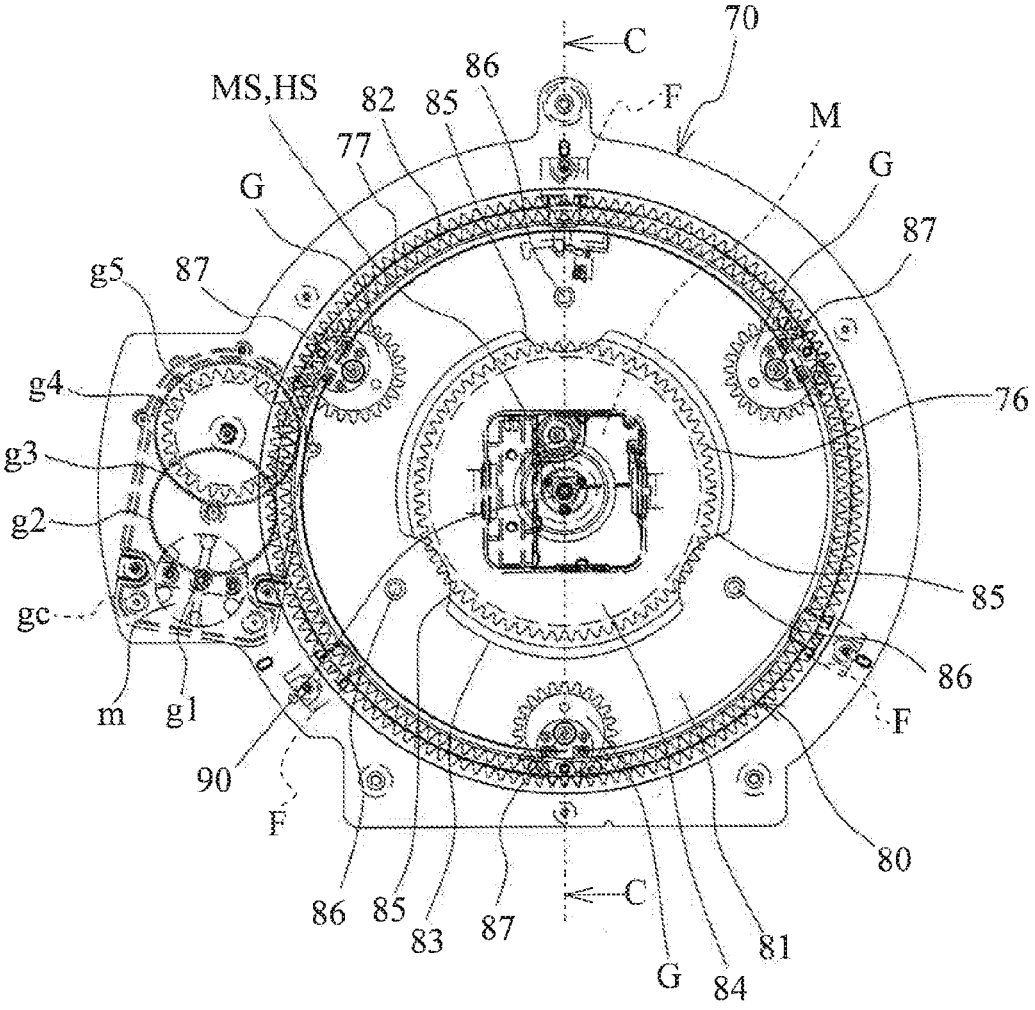
FIG. 9 is an explanatory view of a drive mechanism of the timepiece according to the first variation.
Figure 10:
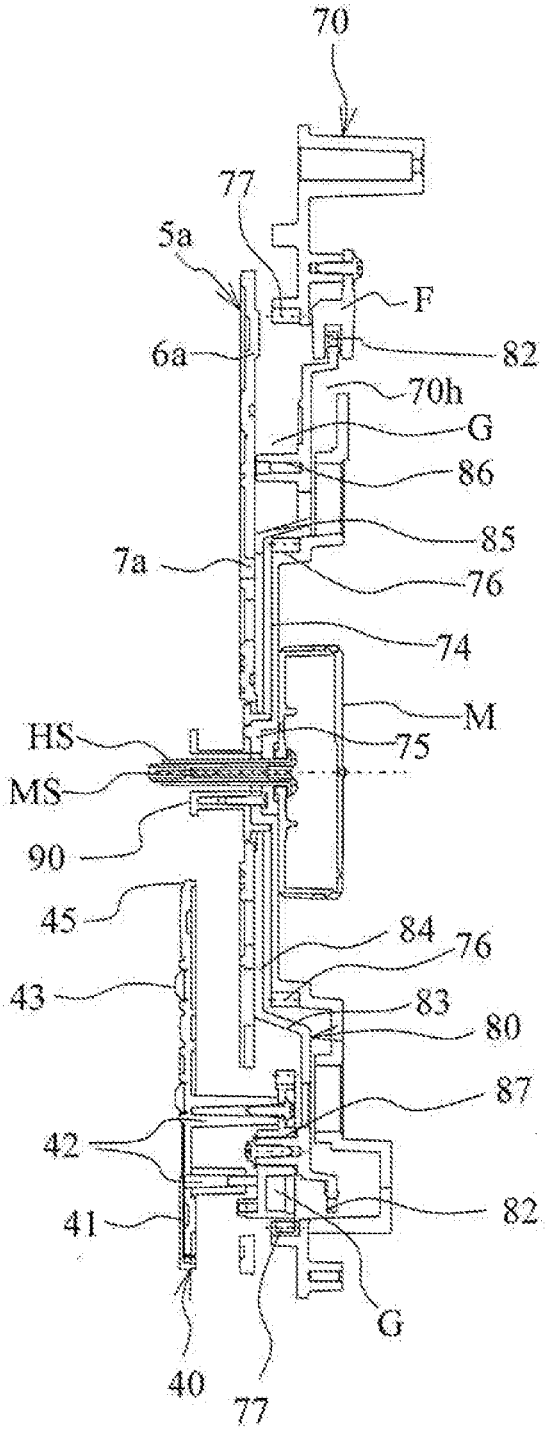
FIG. 10 is a sectional view taken along line C-C of FIG. 9.

FIG. 9 is an explanatory view of a drive mechanism of the timepiece 1*a* according to the first variation. FIG. 10 is a sectional view taken along line A-A of FIG. 9. FIGS. 9 and 10 correspond to FIGS. 3 and 4, respectively. As illustrated in FIG. 9, the drive mechanism of the timepiece 1*a* according to the first variation is similar to the drive mechanism of the timepiece 1. However, in the timepiece 1*a*, the spindle portions 86 do not support the gears G, whereas the spindle portions 87 support the respective gears G. Therefore, the gears G supported by the spindle portions 87 mesh with the inner teeth portion 77 of the base board 70. Thus, for example, when the rotary board 80 rotates clockwise, the gear G rotates counterclockwise by meshing with the inner teeth portion 77 while revolving clockwise. The spindle portions 87 that support the three gears G for rotation are each an example of a second spindle portion. Additionally, as illustrated in FIG. 10, the gear G is secured to plural secured spindles 42 extending from the rear side of a board portion 41 of the ornamental body 40. Likewise, the other ornamental bodies 20 and 60 are secured to the respective gears G.

In comparison between the timepieces 1 and 1*a*, the ornamental bodies 10, 30, and 50 rotate at respective positions close to the center as illustrated in FIG. 2, whereas the ornamental bodies 20, 40, and 60 rotate at respective positions distant from the center as illustrated in FIG. 8. Also, the ornamental body 10, 30, and 50 revolve close to the center, whereas the ornamental bodies 20, 40, and 60 revolve away from the center. This is because the ornamental bodies 10, 30, and 50 are respectively connected to the gears G supported by the spindle portions 86 positioned near the center, whereas the ornamental bodies 20, 40, and 60 are respectively connected to the gears G supported by the spindle portions 87 positioned away from the center.

Also, as illustrated in FIGS. 3 and 9, the gears G supported by the spindle portions 86 and 87 are the same. On the other hand, a pitch diameter of the outer teeth portion 76 meshing with the gears G supported by the spindle portions 86 is smaller than that of the inner teeth portion 77 meshing with the gears G supported by the spindle portion 87. Also, a tooth of the outer teeth portion 76 is the same as that of the inner teeth portion 77 in shape and size. Thus, the rotational speed of the gear G supported by the spindle portion 86 is smaller than that of the gear G supported by the spindle portion 87. Therefore, each revolution speed of the ornamental bodies 10, 30, and 50 is smaller than that of the ornamental bodies 20, 40, and 60. Moreover, as mentioned above, the rotational direction of the ornamental bodies 10, 30, and 50 are different from that of the ornamental bodies 20, 40, and 60. In such a way, the timepieces 1 and 1*a* have different movement of the ornamental body.

In comparison between the timepiece 1 according to the present embodiment described above and the timepiece 1*a* according to the first variation, although the driving ornamental bodies are different from each other, the drive mechanism is the same. Thus, the common drive mechanism can be used for manufacturing the timepieces 1 and 1*a* having different movement of the ornamental body as illustrated in FIGS. 2 and 8. Thus, as compared with a case where different drive mechanisms are used for independently manufacturing timepieces having different movement of the ornamental body, as for the timepieces 1 and 1*a* according to the present embodiment and the first variation, the manufacturing cost is reduced.

Figure 11:
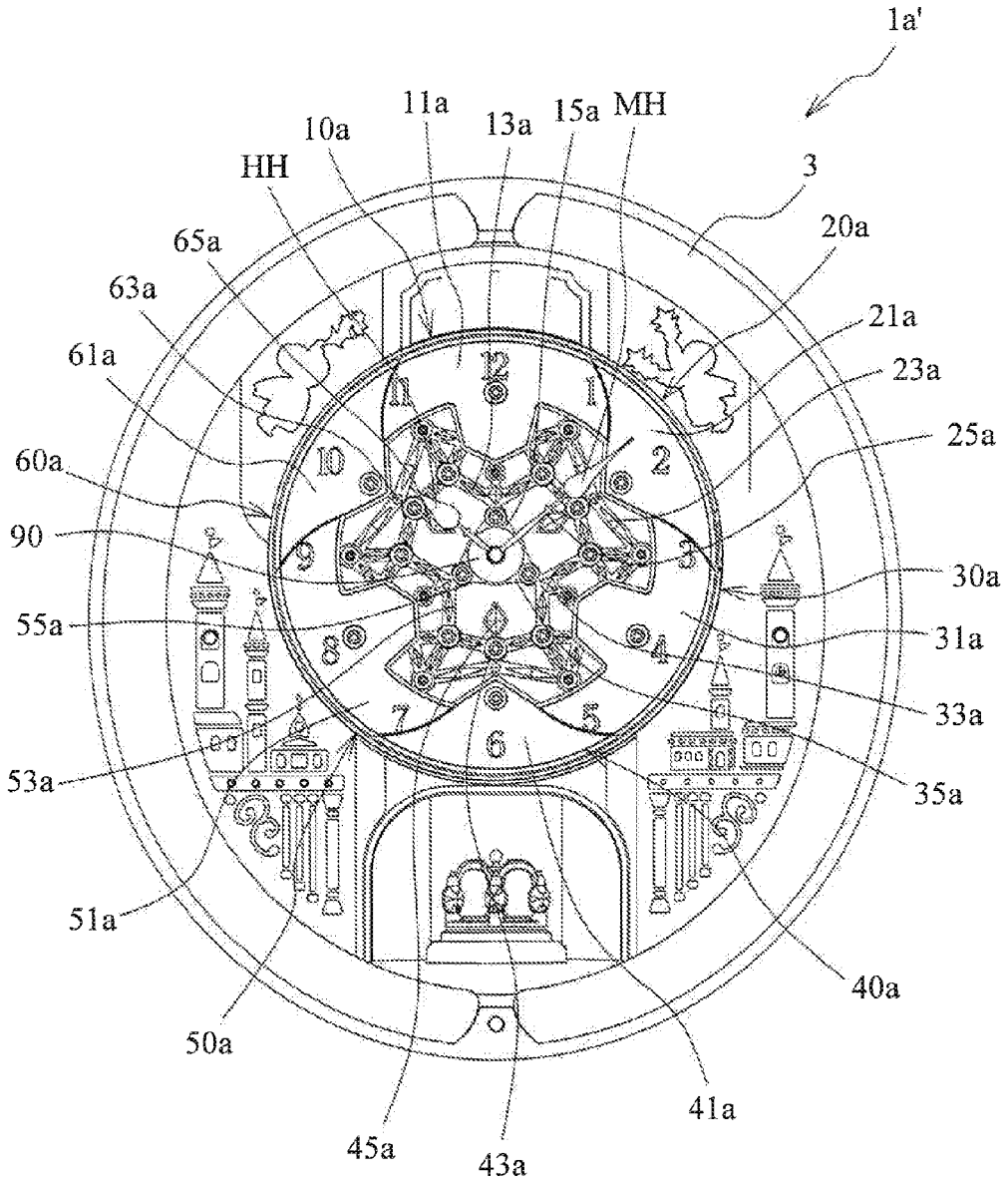
FIG. 11 is a front view of a timepiece according to a second variation.
Figure 12:
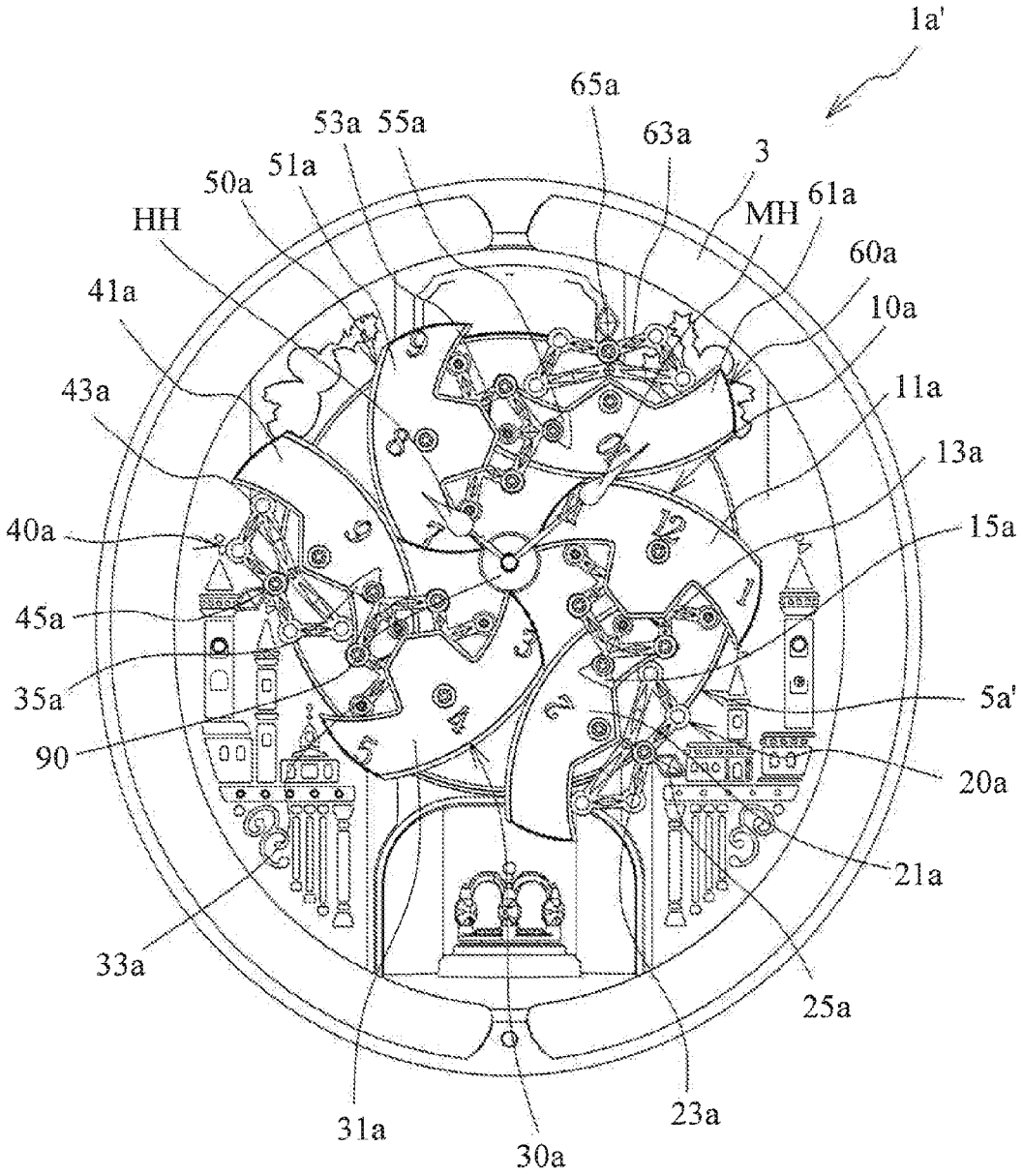
FIG. 12 is a front view of the timepiece according to the second variation.

Next, a timepiece 1*a*' according to a second variation will be described below. FIGS. 11 and 12 are front views of the timepiece 1*a*' according to the second variation. The timepiece 1*a*' employs common components of the timepieces 1 and 1*a*.

As illustrated in FIG. 12, a number is not denoted on a board 5*a*', and decoration is not applied thereto. Ornamental bodies 10*a* to 60*a* are arranged in a front side of the board 5*a*'.

The ornamental bodies 10*a* to 60*a* include board portions 11*a* to 61*a*, ornamental portions 13*a* to 63*a*, and end portions 15*a* to 65*a*, respectively. The numbers 1 to 12 are denoted on the whole board portions 11*a* to 61*a*. The whole of the ornamental bodies 10*a* to 60*a* functions as a single dial plate.

When a predetermined time has come, the board 5*a*' rotates clockwise and the ornamental bodies 10*a* to 60*a* revolve clockwise from an initial state of FIG. 11, as illustrated in FIG. 12. Also, the ornamental bodies 10*a*, 30*a*, and 50*a* rotate clockwise, whereas the ornamental bodies 20*a*, 40*a*, and 60*a* rotate counterclockwise. That is, the ornamental bodies 10*a* and 20*a* revolve in the same direction, whereas rotating in the opposite direction. The ornamental bodies 30*a* and 40*a* have a same arrangement, and the ornamental bodies 50*a* and 60*a* have a same arrangement. Rotational speeds of the ornamental bodies 10*a*, 30*a*, and 50*a* are the same. Rotational speeds of the ornamental bodies 20*a*, 40*a*, and 60*a* are the same. Each rotational speed of the ornamental bodies 10*a*, 30*a*, and 50*a* is smaller than that of the ornamental bodies 20*a*, 40*a*, and 60*a*. After a predetermined time elapses, the ornamental bodies 10*a* to 60*a* return to the respective initial positions. In this way, the ornamental bodies 10*a* to 60*a* revolve and rotate, and the ornamental bodies 10*a* and 20*a* are different from each other in the rotational direction and in the rotational speed. The timepiece 1*a*' presents a wide variety of appearances.

Additionally, in the initial state, the adjacent ornamental bodies partially overlap each other when viewed from the front side. That is, the ornamental bodies 10*a*, 30*a*, and 50*a* are arranged in a front side of the ornamental bodies 20*a*, 40*a*, and 60*a*. For this reason, these ornamental bodies do not come into contact with one another.

Figure 13:
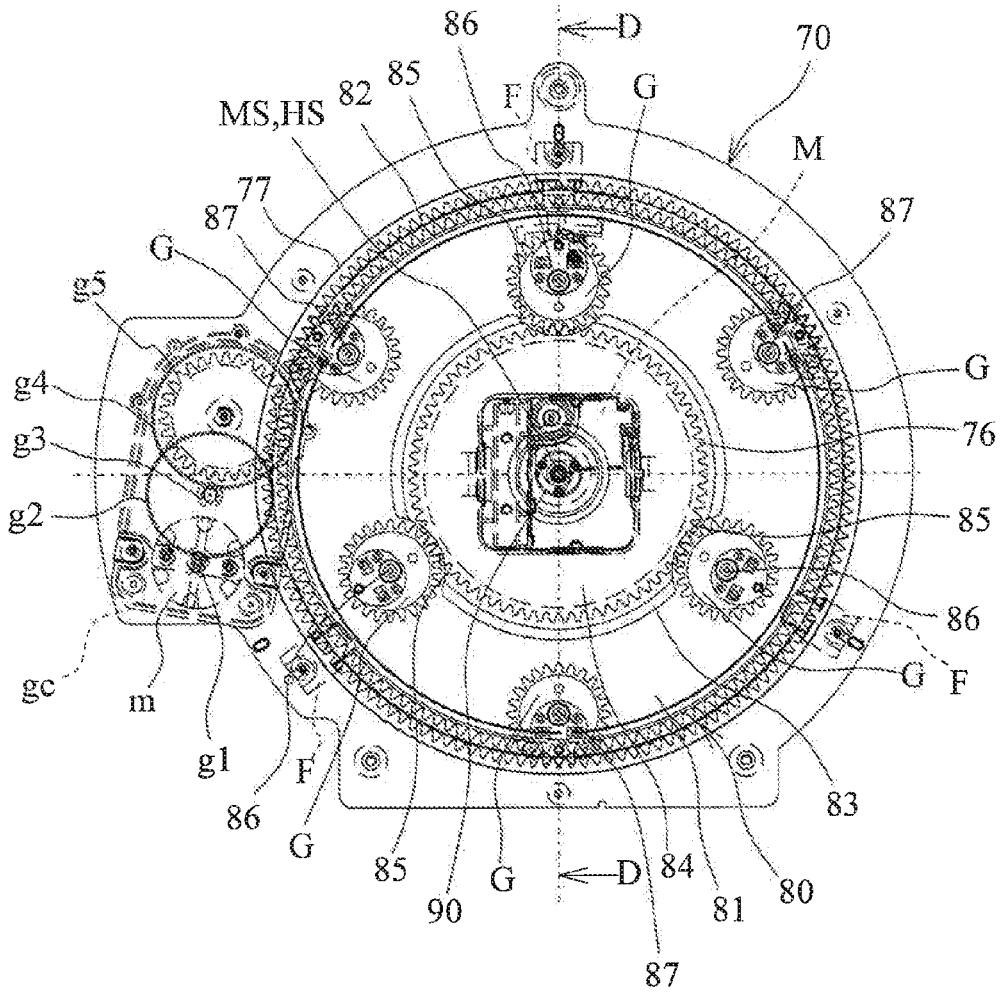
FIG. 13 is an explanatory view of a drive mechanism of the timepiece according to the second variation.
Figure 14:
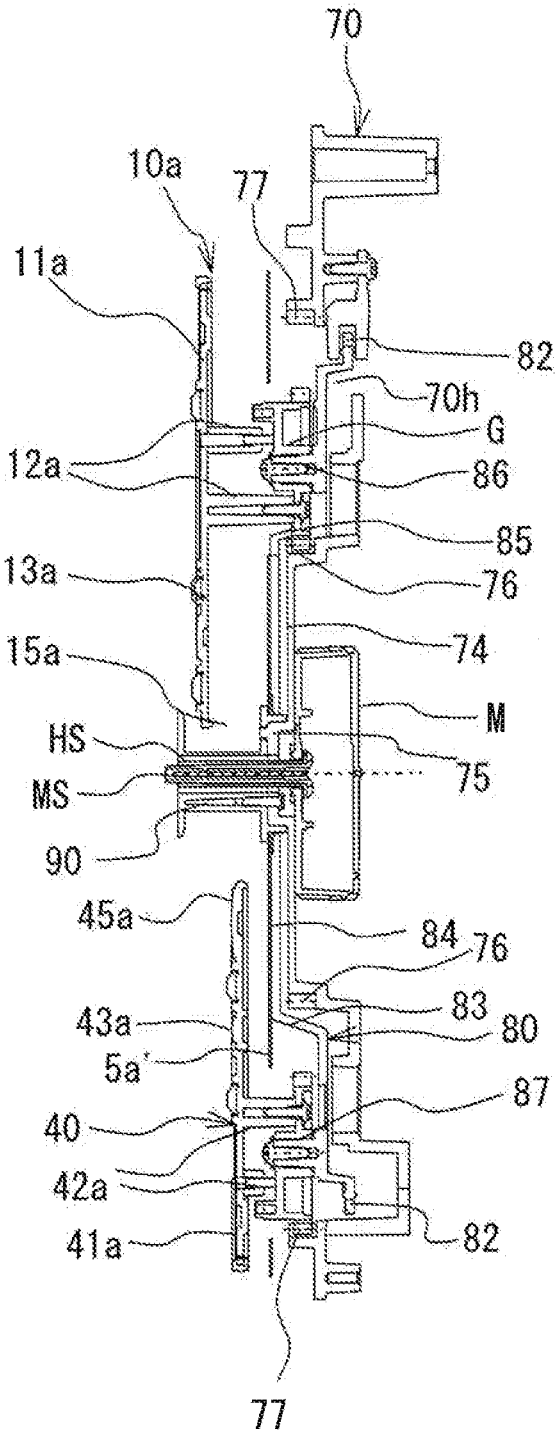
FIG. 14 is a sectional view taken along line D-D of FIG. 13.

FIG. 13 is an explanatory view of the drive mechanism of the timepiece 1*a*'. FIG. 14 is a sectional view taken along line A-A of FIG. 13. FIG. 13 corresponds to FIGS. 3 and 9. FIG. 14 corresponds to FIGS. 4 and 10. The drive mechanism of the timepiece 1*a*' is also the same as the drive mechanisms of the timepiece 1 and 1*a*. But, as for the timepiece 1*a*', both of the spindle portions 86 and 87 support the gears G. As illustrated in FIG. 14, secured spindles 12*a* extending from the rear side of the ornamental body 10*a* is secured to the gear G supported by the spindle portion 86. Likewise, the ornamental bodies 30*a* and 50*a* are secured to the other two gears G supported by the spindle portions 86, respectively. Also, as illustrated in FIG. 14, secured spindles 42*a* extending from the rear side of the ornamental body 40*a* is secured to the gear G supported by the spindle portion 87. Likewise, the ornamental bodies 40*a* and 60*a* are secured to the other two gears G supported by the spindle portions 87.

As illustrated in FIG. 14, the length of the secured spindle 12*a* of the ornamental body 10*a* is different from that of the secured spindle 42*a* of the ornamental body 40*a*. For this reason, the ornamental bodies 10*a* and 40*a* are located at the different height positions from the rotary board 80, whereby the ornamental bodies 10*a* and 40*a* do not come into contact with each other. In addition, the ornamental bodies 30*a* and 50*a* are located at the same height position as the ornamental body 10*a*. The ornamental bodies 20*a* and 60*a* are located at the same height position as the ornamental body 40*a*. Also, the ornamental bodies 10*a*, 30*a*, and 50*a* located at the same height position are arranged at equal angular intervals of 120 degrees in order not to come into contact with one another. The ornamental bodies 20*a*, 40*a*, and 60*a* have a same arrangement.

When viewed from the front side as illustrated in FIGS. 11 and 14, the end portions 15*a*, 35*a*, and 55*a* of the ornamental bodies 10*a*, 30*a*, and 50*a* overlap the flange portion 93 of the securing member 90 illustrated with no numeral in FIG. 14. Therefore, the ornamental bodies 10*a*, 30*a*, and 50*a* are suppressed from coming into contact with the minute hand MH and the hour hand HH in the initial state.

In the timepieces 1, 1*a*, and 1*a*', the common drive mechanism is used. The use of the common drive mechanism makes it possible to reduce the manufacturing costs of the timepieces 1, 1*a*, and 1*a*' having different movement of the ornamental body as illustrated in FIGS. 2, 8, and 12.

While the exemplary embodiments of the present invention have been illustrated in detail, the present invention is not limited to the above-mentioned embodiments, and other embodiments, variations and modifications may be made without departing from the scope of the present invention.

In the above embodiment and variations, the same gears G are supported by the spindle portions 86 and 87. However, the present invention is not limited to this arrangement. For example, as for the respective gears supported by the spindle portions 86 and 87, the size of a tooth or the pitch diameter may be changed. Moreover, corresponding to this, the size or thickness of a tooth of the outer teeth portion 76 or the inner teeth portion 77 may be changed. The position of the spindle portion 86 or 87 may be changed.

The each number of the spindle portions 86 and 87 may be only one. Also, the each number of the spindle portions 86 and 87 may be two or more. In a case where of providing plural spindle portions 86, the spindle portions 86 may not be arranged at equal angular intervals. The spindle portions 87 may not be arranged at equal angular intervals. Thus, two or four or more ornamental bodies that rotate and revolve in the same direction may be provided.

In the above embodiment and variations, the distance from the rotational center to any one of the three spindle portions 86 that are capable of supporting the gears G of the outer teeth portion 76 of the base board 70 is the same. However, the present invention is not limited to this arrangement. For example, there may be provided with a third spindle portion that is closer to the outer teeth portion 76 than to the inner teeth portion 77 and that is different from the spindle portion 86 in distance from the center. For example, in a case where the distance from the rotational center to the third spindle portion is smaller than the distance from the rotational center to the spindle portion 86, the third spindle portion may support a gear, a pitch diameter of which is smaller than that of the gear G supported by the spindle portion 86. Therefore, the gear supported by the third spindle portion can also mesh with the outer teeth portion 76. Also, in a case where the distance from the rotational center to the third spindle portion is greater than the distance from the rotational center to the spindle portion 86, the third spindle portion may support a gear, a pitch diameter of which is greater than that of the gear G supported by the spindle portion 86.

Further, there may be provided with a fourth spindle portion that is closer to the inner teeth portion 77 than to the outer teeth portion 76 and that is different from the spindle portion 87 in distance from the center. For example, in a case where the distance from the rotational center to the fourth spindle portion is smaller than the distance from the rotational center to the spindle portion 87, the fourth spindle portion may support a gear, a pitch diameter of which is greater than that of the gear G supported by the spindle portion 87. Therefore, the gear supported by the fourth spindle portion can also mesh with the inner teeth portion 77. Also, in a case where the distance from the rotational center to the fourth spindle portion is greater than the distance from the rotational center to the spindle portion 87, the fourth spindle portion may support a gear, a pitch diameter of which is smaller than that of the gear G supported by the spindle portion 87.

Moreover, in the above embodiment and variations, the outer flat surface 91*e* is formed into a flat shape. However, the present invention is not limited to this arrangement. The outer frat surface 91*e* has only to have a shape so as not to come into contact with the end portions of the movable ornamental bodies 10, 30, and 50, and may have a recess shape. Additionally, the tube portion 91 is not always limited to have the triangular tube shape. For example, in a case of providing four movable ornamental bodies, the tube portion 91 may have a rectangular tube shape not to come into contact with end portions of the four ornamental bodies. Furthermore, in a case where two movable ornamental bodies are provided, the tube portion 91 may have an oval tube shape or a parallelogram tube shape so as not to come into contact with end portions of the two ornamental bodies.

What is claimed is:

1. A timepiece comprising:

a base board made of any of ABS resin, AS resin, and PS resin, and including a projection portion;

a rotary board made of any of ABS resin, AS resin, and PS resin, and rotatable about and relative to the projection portion;

a rotational shaft projecting toward a front side of the base board through an opening formed in the projection portion, an end of the rotational shaft being connected with a hand provided for indicating time;

an ornamental body movable relative to the base board; and a securing member made of any of POM resin, PBT resin, and PA resin, and including:

a tube portion through which the rotational shaft penetrates;

a flange portion projecting radially outward of the tube portion, and positioned between the hand and a part of the ornamental body when the ornamental body is stopped;

a securing portion secured to the projection portion;

a surrounding portion surrounding the projection portion, the rotary board sliding on outer circumference of the surrounding portion; and a pressing portion positioned in a front side of the rotary board and projecting radially outward from the surrounding portion.

2. The timepiece of claim 1, wherein the tube portion includes a receiving portion for receiving the ornamental body.

3. The timepiece of claim 1, wherein the ornamental body is rotatably supported by the rotary board.

4. The timepiece of claim 1, wherein the ornamental body revolves together with rotation of the rotary board, while the ornamental body is rotating relative to the rotary board.

5. The timepiece of claim 1, wherein the tube portion has a non-cylindrical outer shape, and an end portion of the ornamental body partially overlaps a virtual cylinder concentric with the tube portion, the virtual cylinder passing through a point on the outer profile, the point being the most distant from a center of the tube portion.

* * * * *